US005544564A

United States Patent [19]

Balbo et al.

[11] Patent Number: 5,544,564

[45] Date of Patent: Aug. 13, 1996

[54] ASSEMBLY FOR THE REMOVABLE FASTENING OF THE CRADLE TO THE BREECH OF A WEAPON

[75] Inventors: Patrick Balbo; Philippe Grelat, both of Bourges; Guy Malassenet, Pigny; Fabienne Mandereau, Bourges, all of France

[73] Assignee: Giat Industries, Versailles, France

[21] Appl. No.: 447,937

[22] Filed: May 23, 1995

[51] Int. Cl.[6] ..... F41A 3/66; F41A 21/48

[52] U.S. Cl. ..... 89/37.01; 42/75.02

[58] Field of Search ..... 42/75.02; 89/24, 89/22, 19, 17, 37.01, 40.01, 37.07

[56] References Cited

U.S. PATENT DOCUMENTS 1,065,341 6/1913 Browning ..... 42/75.02

5,247,758 9/1993 Mason ..... 42/75.02

FOREIGN PATENT DOCUMENTS 704640 4/1941 Germany ..... 42/75.02

1083762 9/1967 United Kingdom ..... 42/75.02

*Primary Examiner*—Stephen M. Johnson

*Attorney, Agent, or Firm*—Oliff & Berridge

[57] ABSTRACT

A weapon is fitted with a barrel that is screwed into a breech ring and is mobile in axial translation with respect to a cradle. The assembly also comprises removable fastening structure to fasten the breech ring directly onto the cradle and relative coaxial centering structure for centering the cradle and the breech ring.

20 Claims, 2 Drawing Sheets

ASSEMBLY FOR THE REMOVABLE FASTENING OF THE CRADLE TO THE BREECH OF A WEAPON

BACKGROUND OF THE INVENTION

The present invention relates to an assembly for the removable fastening of the cradle to the breech of a weapon.

On many weapons, the dismounting of the gun barrel, and possibly its replacement, must be carried out from the front. On a tank for example, before undertaking this disassembly, the breech ring is linked to the turret roof using a suitable temporary fastening. The breech ring is thereafter linked to the cradle by a flange fastened to the breech ring and to the cradle by screw-nut connections. This flange enables the cradle to effectively withstand the weight of the breech ring when the breech ring is no longer supported by the barrel.

However, this type of assembly does not provide a sufficiently accurate position of the breech ring with respect to the cradle, thereby making difficult the installation and screwing into place of a new barrel that demands that the two parts be coaxial. Moreover, this positioning defect leads to the appearance of strains in the brake rods and in the recuperator, which also helps to support the breech ring with respect to the cradle. A frequent direct consequence of this is the deterioration of the brake rods, which in turn may cause the deterioration of the seals.

SUMMARY OF THE INVENTION

One aim of the invention is, for this reason, to propose an assembly enabling the removable fastening of the breech ring to the cradle, ensuring an accurate relative axial position of the two parts thereby eliminating the risk of deteriorating the seals.

One aspect of the invention is thus an assembly comprising a weapon fitted with a barrel screwed into a breech ring and mobile in translation with respect to a cradle, the assembly also comprising removable fastening structure for fastening the breech ring directly onto the cradle when they are in contact with one another.

According to the invention, this assembly is characterised in that the fastening structure comprises relative coaxial centering structure for the cradle and the breech ring.

The breech ring is therefore arranged coaxially to the cradle as soon as it enters into contact with the cradle and is fastened. The centering structure guarantees that this coaxial position will be held throughout the duration of the fastening. The brake rods and recuperators are thus no longer subject to strain, which avoids the risk of their deterioration due to inaccurate fastening.

According to an advantageous version of the invention, the centering structure may also form support structure arranged so as to enable the cradle to withstand the weight of the breech ring in its fastened position.

Thus a saving is made on the number of parts required by grouping together in the same elements the two essential functions of centering and vertical support.

According to another advantageous version of the invention, the centering structure may also form immobilization structure for the breech ring with respect to the cradle in orthogonal translation to the axis of the breech ring, in the fastened position.

The strains orthogonal to the axis to which the breech ring may be subjected and which would tend to move the breech ring with respect to the cradle are therefore absorbed by the centering structure such that yet a further reduction of parts is achieved.

According to another advantageous version of the invention, the fastening structure may comprise immobilization structure for the breech ring with respect to the cradle in rotation and in translation with respect to the axis of the breech ring.

According to a preferred version of the invention, the immobilization structure is separate from the centering structure.

By separating the elements carrying out these two functions, the configuration and arrangement of the elements may be defined in the most suitable manner to fulfil each of the functions.

According to a preferred version of the invention, the centering structure may comprise outward projecting structure along the axial direction and recesses, respectively, on the breech ring and on the cradle, or on the cradle and on the breech ring, the recesses being arranged so as to accommodate the outward projecting structure.

According to another preferred version of the invention, the immobilization structure may comprise a flange having at least one protuberance, the breech ring and the cradle each having a generally radial channel, the channels being parallel to each other and arranged to accommodate the protuberance or protuberances, and the immobilization structure comprises structure to attach the flange to the cradle and to the breech ring along the axial direction.

BRIEF DESCRIPTION OF THE DRAWINGS

Other characteristics and advantages of the invention will become apparent from the description given hereafter of preferred embodiments in the appended drawings given by way of a non-exhaustive illustration, wherein.

DETAILED DESCRIPTION OF PREFERRED EMBODIMENTS

Figure 1:
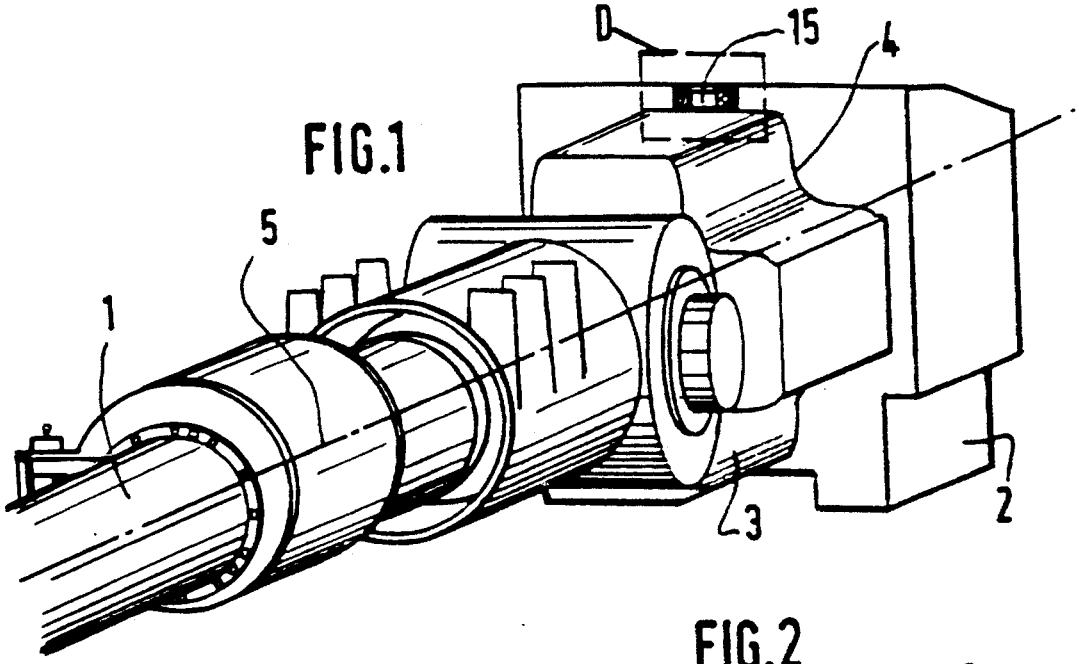
FIG. 1 is a perspective view of the ordnance of a weapon of the assembly according to the invention before the barrel has been dismounted.

With reference to FIG. 1, the present embodiment of the assembly according to the invention comprises a weapon which, in this example, is a tank. The tank ordnance is fitted with a barrel 1 screwed into a breech ring 2 and is mobile in axial translation with respect to a cradle 3, according to a conventional arrangement. The barrel 1, the cradle and the breech ring 2 share a common axis 5 when they are in this configuration.

To dismount the barrel 1, the assembly comprises fastening means of the cradle 3 to the tank turret (not shown). These means are conventional and therefore, have not been shown. The assembly also comprises removable fastening means to fasten the breech ring 2 directly onto the cradle 3 when it is in contact with the cradle by its face 4 turned towards the breech ring.

According to the invention, the fastening means comprises relative coaxial centering means for the cradle 3 and the breech ring 2, i.e., means ensuring that the breech ring and the cradle are coaxial when the breech ring 2 is fastened to the cradle 3. In this example, the centering means also forms support means arranged to enable the cradle to withstand the weight of the breech ring in its fastened position, as well as immobilization means for the breech ring 2 with respect to the cradle 3 in orthogonal translation to the axis 5 of the breech ring, in the fastened position.

Figure 3:
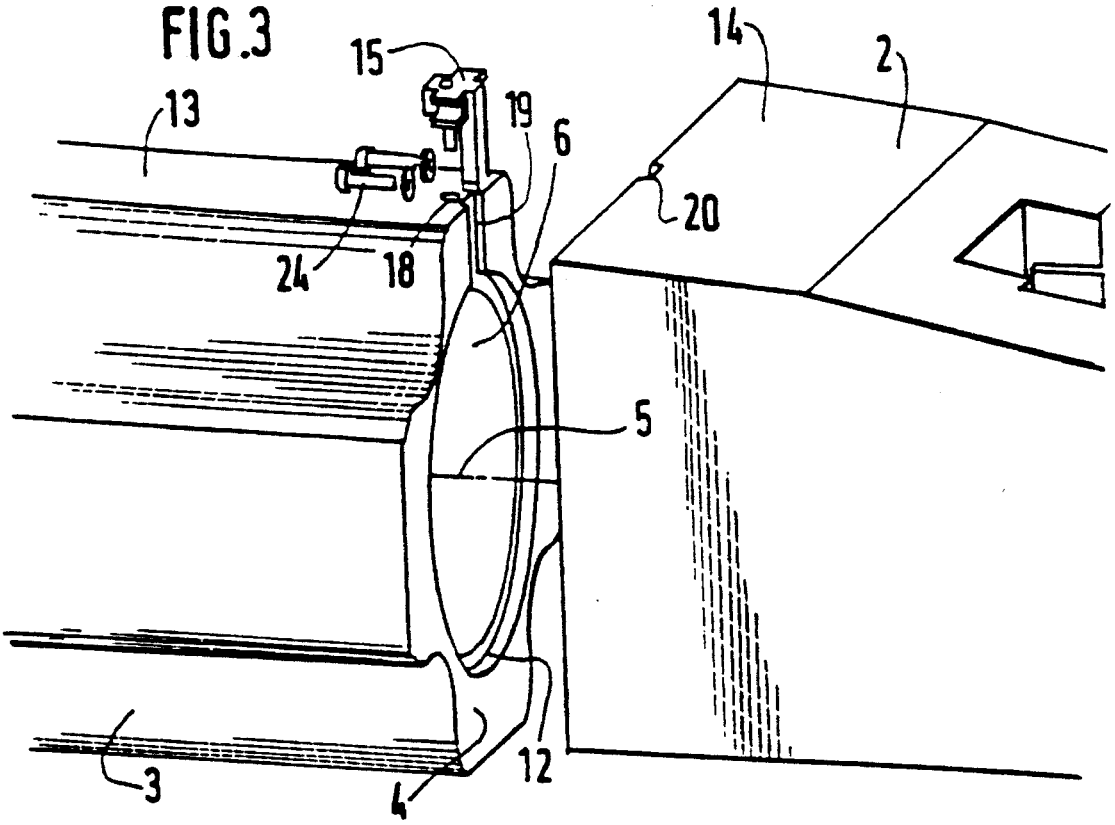
FIG. 3 is an exploded perspective view of the assembly in FIG. 1.
Figure 4:
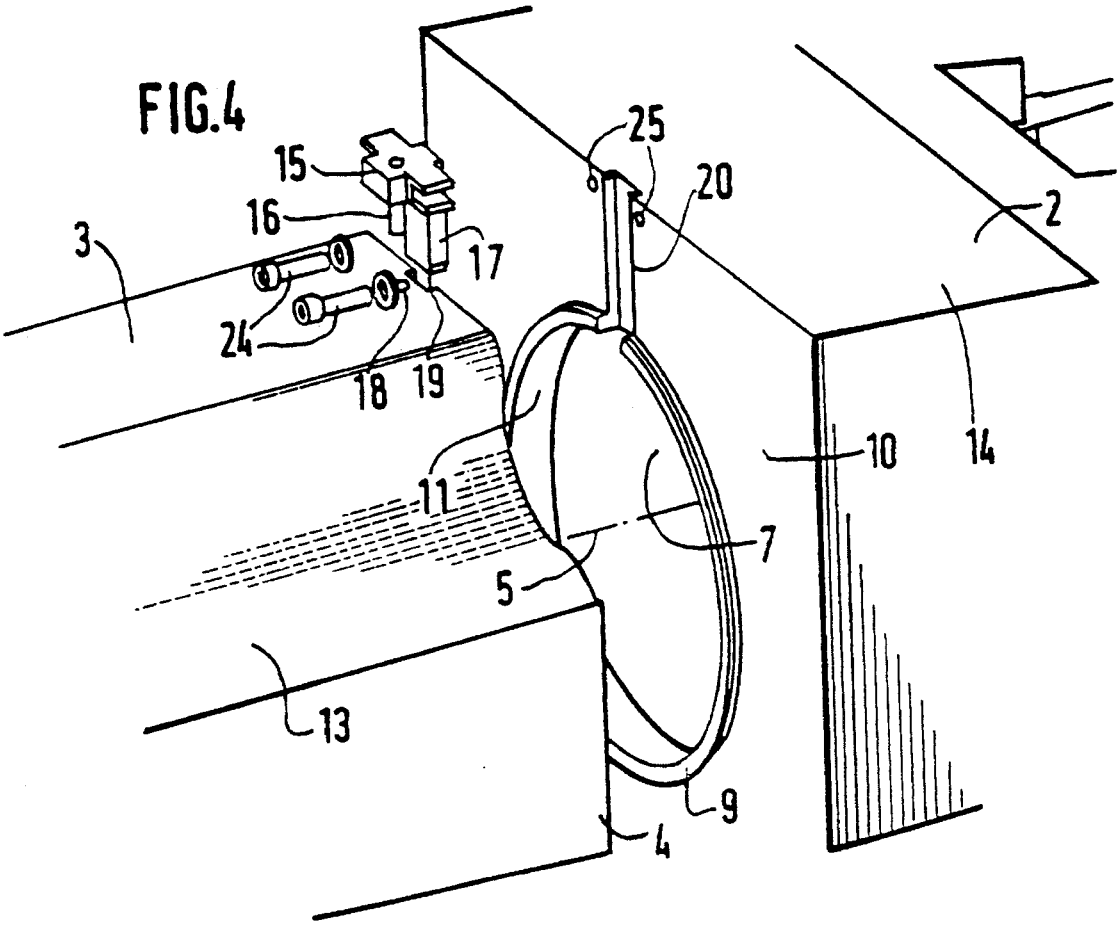
FIG. 4 is an exploded perspective view of the assembly in FIG. 1 from a different viewing angle.

In the present embodiment and with reference to FIGS. 3 and 4, the centering means is arranged so as to be located in the immediate vicinity of an inner face 6, 7 of the cradle 3 and the breech ring when the breech ring 2 is fastened to the cradle 3.

The centering means is formed of outward projecting means 9 along the axial direction and recesses 12, respectively, on the breech ring and on the cradle 3, the recesses 12 being arranged to accommodate the outward projecting means 9. Nevertheless and alternatively, the outward projecting means and the recesses might be present respectively on the cradle 3 and on the breech ring 2.

In this example and with reference to FIG. 4, the outward projecting means comprises a ring-shaped edge 9 that is coaxial to the axis 5 of the breech ring 2 and projects from the face 10 of the breech ring 2, which is turned towards the face 4 of the cradle 3. The inner face 11 of the edge 9 lies in the prolongation of the inner face 7 of the breech ring 2 which is in contact with the barrel 1 when the barrel is put into place. The edge 9 is thus relatively close to the axis 5.

With reference to FIG. 3, the recess is composed of a ring-shaped groove 12 on the face 4 of the cradle 3. This groove 12 is in contact with the inner face 6 of the cradle designed to accommodate the barrel 1 and also lies very near to the axis 5.

The diameter and thickness of the edge 9 and of the groove 12 are substantially equal, the dimensions of the edge 9 being slightly smaller than those of the groove 12 so as to enable the groove 12 to accommodate the edge 9 when the parallel faces 4 of the cradle and 10 of the breech ring 2 are in contact with one another.

The edge 9 is sufficiently thick and the groove 12 is sufficiently deep to enable the edge 9 to support the breech ring 2 in the fastening position shown in FIG. 1. For example, this thickness and this depth will be around 5 to 10 millimeters.

The fastening means also comprises immobilization means for the breech ring 2 with respect to the cradle 3 in rotation and in translation with respect to the axis 5 of the breech ring, the immobilization means being, in this example, separate from the centering means.

The immobilization means is arranged to lie in the immediate vicinity of the outer faces 13 and 14 of the cradle and of the breech ring 2 when the breech ring is fastened to the cradle.

In the present example, the immobilization means comprises a flange 15 having a first 16 and a second 17 protuberance, which are respectively a tubular finger 16 and a rectangular parallelepiped 17. The tubular finger is, in this example, cylindrical.

In addition, the breech ring 2 and the cradle 3 each have at least one channel which is generally radial to the axis 5. In this example, the cradle has a tubular recess 18 and the cradle 3 and the breech ring 2 have, respectively, the first 19 and second 20 incisions.

Figure 2:
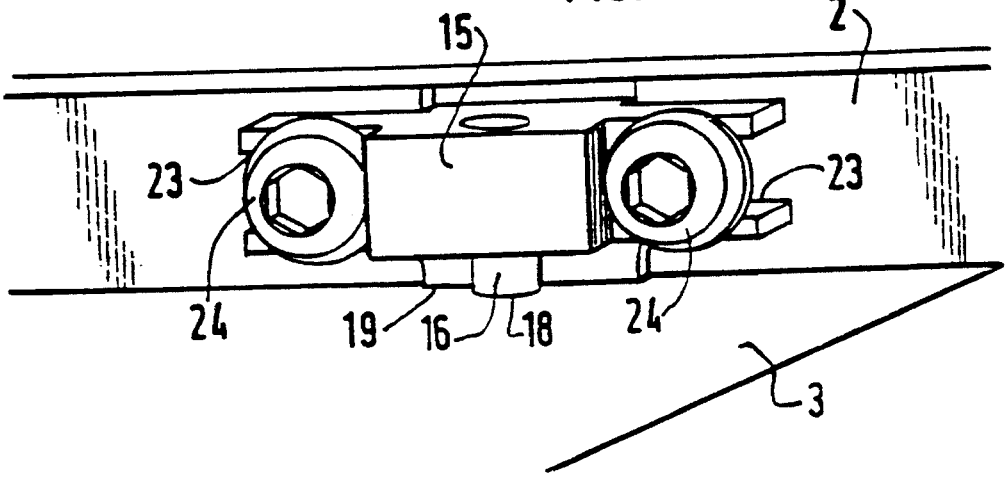
FIG. 2 is an enlarged view of the detail D in FIG. 1.
Figure 5:
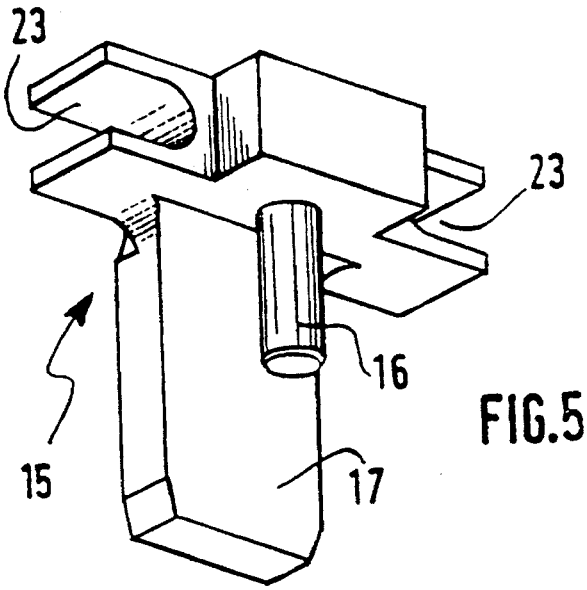
FIG. 5 is a perspective view of the flange.

These channels 18, 19, 20 are parallel with one another and are arranged to accommodate the protuberances of the flange 15 when the flange is in the fastening position shown in FIGS. 1 and 2. Thus, the tubular recess 18 may accommodate the tubular finger 16 and the first and second incisions 19, 20 are arranged to work together in order to accommodate the rectangular parallelepiped 17. When the two faces 4 and 10 are in contact with one another, the two incisions 19, 20 comprise a rectangular parallelepiped arranged to accommodate the rectangular parallelepiped 17.

The incisions 19, 20 in the present example already exist before the invention and initially provide accommodation for the linch pin of the barrel 1 with respect to the breech ring 2. Nevertheless, their use in accommodating the rectangular parallelepiped 17 is new and adds to the invention.

The immobilization means comprises in addition means to attach the flange 15 to the cradle and to the breech ring 2 along the direction of the axis 5, i.e., in order to prevent its relative movement in this direction. The attachment means comprises screw-nut connections, comprising screws 24 and threaded holes 25 on the front face 10 of the breech ring 2. The screws 24 are arranged such that they pass through two lateral notches 23 on the flange 15 and face the axial direction when the breech ring 2 is fastened to the cradle 3.

The assembly which has just been described is used in the following manner.

It is presumed that the barrel 1 needs to be dismounted after being used.

The cradle 3 is linked to the turret of the tank in a conventional manner.

The breech ring 2 is brought into contact with the rear face 4 of the cradle 3 because of the strain generated by the recuperators, the edge 9 lying in the groove 12.

The user removes the linch pin and puts the flange 15 into place. The channels 18, 19 and 20 being radial to the axis 5, the flange is put into position by means of a vertical movement towards the orthogonal bottom of the axis 5. In FIGS. 3 and 4, the flange is shown in the process of carrying out this movement. During installation, the tubular finger 16 penetrates in the tubular recess 18 and the rectangular parallelepiped 17 penetrates between the incisions 19 and 20.

At the end of the flange's 15 course of movement, the user fastens the flange to the face 10 of the breech ring by means of screws 24 passing through notches 23 and coming to fit in the threaded holes 25. The flange 15 such as that installed is shown in FIG. 2.

The user may thereafter fully unscrew the barrel 1. When the barrel has been removed, the breech ring 2 is fastened accurately and sturdily to the cradle 3 and the barrel 1 or another barrel may be put into position in the breech ring and the cradle 3 with no problems.

In fact, the edge 9 accommodated by the groove 12 ensures the exact coaxial centering of the breech ring and the cradle, and prevents any relative orthogonal translation to the axis 5. Thanks to the channels 18, 19 and 20, the flange 15 is easily and accurately put into position with respect to the cradle 3 and the breech ring. The fastening of the flange by means of screws 24 and the engagement of the tubular finger 16 in the tubular recess 17 prevent any relative translation of the cradle and the breech ring 2 along the axis 5. The incisions 19 and 20 prevent any relative rotation of the two parts around the axis 5.

In the fastened position of the breech ring to the cradle, the fastening means ensures good transmission of the strain between these two parts thus protecting the brake rods and recuperator.

To reassemble the barrel 1, the user introduces the barrel into the cradle 3 and screws it into the breech ring. He removes the flange 15 and puts the linch pin back into position.

Of course, numerous modifications and improvements may be brought to the invention without leaving its scope.

For example, the centering means might only comprise an edge section 9 and a matching groove section 12, so as to group the centering and rotation blocking functions.

The assembly might also comprise outer lateral spindles to fasten the breech ring 2 to the cradle 3.

We claim:

1. A weapon assembly for centering and releasably attaching a cradle to a breech ring, said assembly comprising:

a centering device formed as an integral portion of each of the cradle and the breech ring;

a common channel adjacent the centering device that is radially formed when the cradle and the breech ring are engaged in a fastened position; and a releasable fastener disposed at least partially within the common channel.

2. An assembly according to claim 1, wherein the centering device further comprises a support arranged to enable the cradle to withstand the weight of the breech ring in the fastened position.

3. An assembly according to claim 1, wherein the centering device further comprises immobilization structure that prevents the breech ring from moving with respect to the cradle in a direction substantially perpendicular to a longitudinal axis of the breech ring.

4. An assembly according to claim 1, wherein the centering device includes an outward projection cooperable with at least one recess along an axial direction, said at least one recess being formed on one of the breech ring and the cradle, the outward projection being formed on the other of the cradle and the breech ring, the at least one recess being arranged to accommodate the outward projection.

5. An assembly according to claim 4, wherein the outward projection and the at least one recess are respectively formed by an edge and a groove that are both substantially ring-shaped and coaxial to a common longitudinal axis of the breech ring and the cradle.

6. An assembly according to claim 1, wherein the releasable fastener comprises an immobilizer that prevents both relative axial and rotative movement between the breech ring and the cradle.

7. An assembly according to claim 6, wherein the immobilizer is separate from the centering device.

8. An assembly according to claim 6, wherein the centering device and the immobilizer are respectively arranged so as to lie adjacent inner and outer respective faces of the cradle and the breech ring.

9. An assembly according to claim 6, wherein the immobilizer comprises a flange having at least one protuberance, the breech ring and the cradle each having at least one generally radial channel that together make up the common channel, the radial channels being parallel to each other and arranged to accommodate the at least one protuberance, the immobilizer further comprising an attachment for attaching the flange to the cradle and the breech ring along an axial direction.

10. An assembly according to claim 9, wherein at least one of the radial channels is an incision in a wall of one of the breech ring and the cradle.

11. An assembly according to claim 9, wherein the at least one protuberance of the flange comprises a first protuberance and a second protuberance, the cradle having a first channel to accommodate the first protuberance, and a first incision that cooperates with a second incision of the breech ring to jointly accommodate the second protuberance.

12. An assembly according to claim 9, wherein at least one of the channels is a tubular recess.

13. An assembly according to claim 9, wherein at least one of the protuberances is a tubular finger.

14. An assembly according to claim 9, wherein at least one of the protuberances is a rectangular parallelepiped.

15. An assembly according to claim 9, wherein the attachment comprises screw-nut connections arranged to face in the axial direction when the breech ring is fastened to the cradle.

16. A weapon assembly for centering and releasably attaching a cradle to a breech ring, said assembly comprising:

means for centering the cradle and the breech ring, said means for centering being formed as an integral portion of each of the cradle and the breech ring;

a common channel adjacent the means for centering that is radially formed when the cradle and the breech ring are engaged in a fastened position; and releasable fastening means disposed at least partially within the common channel, said releasable fastening means being provided for releasably fastening the breech ring directly onto the cradle.

17. An assembly according to claim 16, wherein the centering means comprises a first structure that substantially prevents movement between the breech ring and the cradle in a direction perpendicular to a longitudinal axis common to both the breech ring and the cradle, and the releasable fastening means comprises a second structure that substantially prevents relative rotation and relative axial movement between the cradle and the breech ring.

18. An assembly according to claim 17, wherein the first structure includes an outward projection cooperable with at least one recess along an axial direction, said at least one recess being formed on one of the breech ring and the cradle, the outward projection being formed on the other of the cradle and the breech ring, the at least one recess being arranged to accommodate the outward projection.

19. An assembly according to claim 17, wherein the second structure comprises a flange having at least one protuberance, the breech ring and the cradle each having at least one generally radial channel that together make up the common channel, the radial channels being parallel to each other and arranged to accommodate the at least one protuberance, the second structure further comprising an attachment for attaching the flange to the cradle and the breech ring along an axial direction.

20. An assembly according to claim 19, wherein at least one of the radial channels is a tubular recess and the at least one protuberance is a tubular finger.

* * * * *